US008875930B2

(12) United States Patent
Felicetti

(10) Patent No.: US 8,875,930 B2
(45) Date of Patent: Nov. 4, 2014

(54) EMESIS CONTAINER

(76) Inventor: Jeffrey Dhom Felicetti, Massapequa, NY (US)

( * ) Notice: Subject to any disclaimer, the term of this patent is extended or adjusted under 35 U.S.C. 154(b) by 0 days.

(21) Appl. No.: 13/454,019

(22) Filed: Apr. 23, 2012

(65) Prior Publication Data

US 2013/0277369 A1 Oct. 24, 2013

(51) Int. Cl.
*B65F 1/06* (2006.01)
*B65F 1/04* (2006.01)

(52) U.S. Cl.
CPC . *B65F 1/062* (2013.01); *B65F 1/06* (2013.01); *B65F 2230/116* (2013.01); *B65F 2230/148* (2013.01)
USPC ..... 220/495.08; 220/495.07

(58) Field of Classification Search
CPC ..... B65F 1/06; B65F 1/04; B65F 2230/112; B65F 2230/116; B65F 2230/148; B65F 1/062
USPC ..... 220/495.09, 495.08, 495.06, 495.11, 220/504, 503, 500, 23.89, 23.87, 23.86, 220/264, 263, 262, 260, 770, 761, 495.07, 220/908.1, 908, 482, 481, 480, 476, 832, 220/831; D34/9, 8, 7
See application file for complete search history.

(56) References Cited

U.S. PATENT DOCUMENTS

| | | | | | |
|---|---|---|---|---|---|
| 696,832 | A * | 4/1902 | Maschke | 220/495.08 |
| 1,013,775 | A * | 1/1912 | Hoffman | 232/1 R |
| 1,072,022 | A * | 9/1913 | Miller | 232/43.5 |
| 2,242,698 | A * | 5/1941 | Evitt | 220/263 |
| 2,596,974 | A * | 5/1952 | Angelo | 220/482 |
| 3,144,152 | A * | 8/1964 | Kopp | 215/6 |
| 3,800,503 | A * | 4/1974 | Maki | 53/390 |
| 4,753,367 | A * | 6/1988 | Miller et al. | 220/495.11 |
| 4,861,301 | A * | 8/1989 | Pomeroy et al. | 441/131 |
| 4,917,263 | A * | 4/1990 | Korb | 220/495.09 |
| 4,921,114 | A | 5/1990 | Rome | |
| 4,972,966 | A * | 11/1990 | Craft, Jr. | 220/264 |
| 5,183,174 | A * | 2/1993 | Quintero | 220/495.08 |
| 5,503,292 | A * | 4/1996 | Cuccharia | 220/495.07 |
| 5,590,804 | A * | 1/1997 | Crum et al. | 220/483 |
| 5,971,969 | A | 10/1999 | Cashel | |
| 6,029,844 | A * | 2/2000 | Brady | 220/495.08 |
| 6,253,949 | B1 * | 7/2001 | Dickson | 220/495.04 |
| 6,991,373 | B2 | 1/2006 | Carr et al. | |
| 2002/0179478 | A1 * | 12/2002 | Silvers | 206/494 |
| 2005/0067474 | A1 * | 3/2005 | Wang | 229/117.35 |
| 2005/0261644 | A1 | 11/2005 | Fields | |
| 2007/0045323 | A1 * | 3/2007 | Kroiss | 220/495.06 |
| 2009/0084794 | A1 * | 4/2009 | Vaiana et al. | 220/495.06 |
| 2009/0236345 | A1 * | 9/2009 | Mack-Robles et al. | 220/495.07 |
| 2010/0096389 | A1 * | 4/2010 | Volpe et al. | 220/501 |

* cited by examiner

*Primary Examiner* — Robert J Hicks
(74) *Attorney, Agent, or Firm* — Collard & Roe, P.C.

(57) ABSTRACT

An emesis container comprising a housing having a first compartment, and at least one open end. There is also a plurality of handles coupled to the housing. In addition, there is also at least one second compartment coupled to the housing. Furthermore, there is at least one disposable container element disposed in the second compartment. The disposable container element can be a bag such as in the form of a disposable trash bag that can be pulled up and over the open end of the housing. There can also be a connector coupled to the housing as well. The connector can be used to releasably connect the emesis container to a base.

19 Claims, 11 Drawing Sheets

FIG. 4A
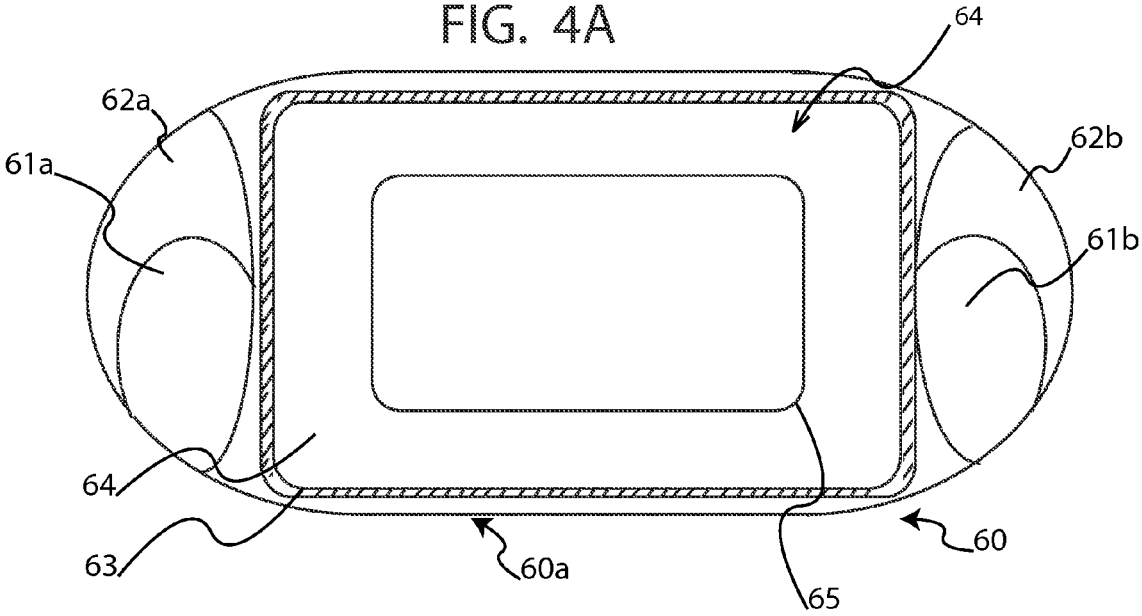
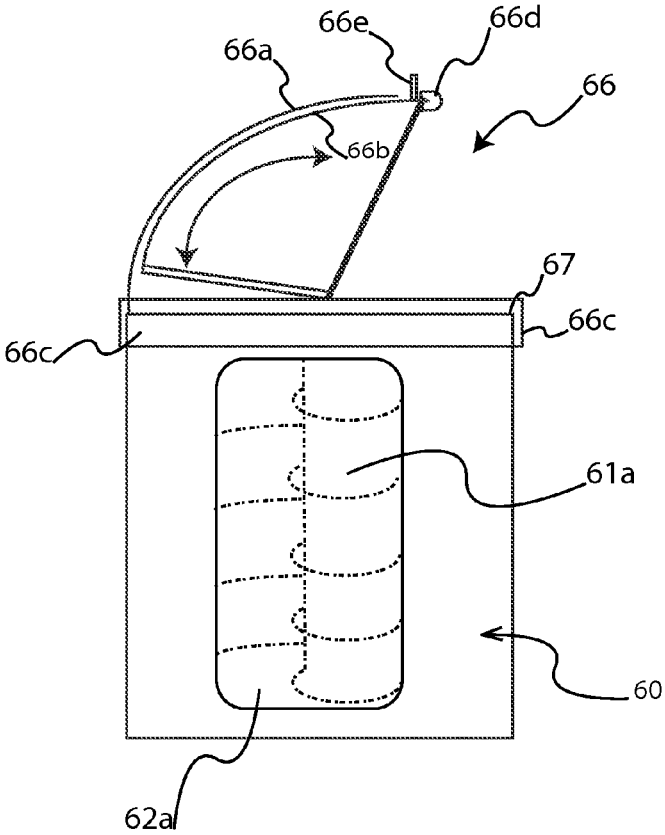
FIG. 4B

EMESIS CONTAINER

BACKGROUND OF THE INVENTION

At least one embodiment of the invention relates to an emesis container which is configured to be positioned in a convenient manner and which is configured to be easy to use and portable.

SUMMARY OF THE INVENTION

At least one embodiment of the invention relates to an emesis container comprising a housing having a first compartment, and at least one open end. There are also a plurality of handles coupled to the housing. In addition, there is also at least one second compartment coupled to the housing. Furthermore, there is at least one disposable container element disposed in the second compartment.

In another embodiment, there is an emesis container comprising a first housing having at least one first opening at a first end, and a second opening at a second end. There is also a second housing having an opening aligned with the second opening of the first housing. There is also a plurality of bags stored in the second housing. Furthermore, there is also a connector configured to selectively connect the second housing to the first housing. In addition, there is also a connector configured to selectively connect the first housing to another element for support. This embodiment can also include at least one detachable rim, wherein the at least one detachable rim is configured to be positioned over a portion of a bag positioned over the first opening of the first housing to hold the bag in place and wherein the housing further comprises at least one recess disposed in the housing, and wherein the device further comprises at least one handle coupled to the housing and disposed in the recess of the housing.

In all, there is an easily configurable and attachable emesis container that can be conveniently used and then stored back in its original position.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 4A is a top view of the emesis container without a cover;

FIG. 4B is a side view of an emesis container having a connector;

DETAILED DESCRIPTION OF PREFERRED EMBODIMENTS

Figure 1A:
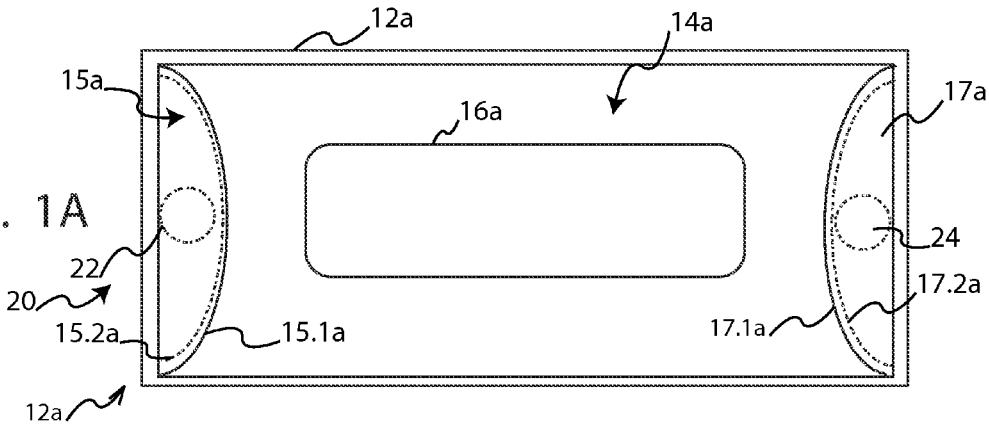
FIG. 1A is a top view of an emesis container.

Referring in detail to the drawings, FIG. 1A is a top view of an emesis container. This container 10 includes a first housing 12*a*, which can be of any suitable shape and be made from any suitable material. In at least one embodiment, housing 12*a* can be made from a plastic container made from any suitable plastic material and shaped with a cross sectional opening that is rectangular as shown by the opening shown in FIG. 1A. Housing 12*a* includes a top opening 14*a*, and a bottom opening 16*a*. Top opening 14*a* is configured to receive emesis refuse, and other materials such as garbage. Bottom opening 16*a* is configured to open to receive an attachment such as a second container 50 (See FIG. 3A) which is configured to house at least one disposable container element such as trash bags 56.

Housing 12*a* includes recessed regions 15*a* and 17*a* or recesses, wherein recessed regions 15*a* and 17*a* are configured of any suitable shape but in at least this embodiment are shown as substantially oval or egg shaped recesses. Other suitable recess shapes could be rectangular, square, circular, tear drop shaped etc. These recesses are configured to receive or at least allow the interior placement of at least one handle 20. For example, there are two handles 22 and 24 which are disposed inside of recesses 15*a* and 17*a*. These recesses are bounded by an inner surface 15.1*a* and an outer surface 15.2*a* for recess 15*a* and inner surface 17.1*a* and outer surface 17.2*a* for recess 17*a*. The dashed-dotted lines denoting handles 22 and 24 as well as recesses 15.2*a* and 17.2*a* relate to elements that are not ordinarily visible from this top view.

Figure 1B:
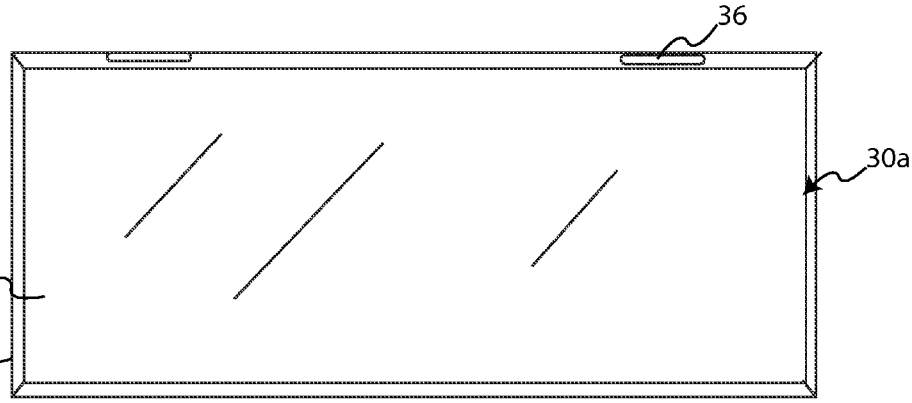
FIG. 1B is a top view of a lid for an emesis container.

Housing 12*a* includes an upper rim 11*a* (See FIG. 1C) and a lower rim 19*a*. Housing upper rim 11*a* is configured to receive a top such as top 30*a* (See FIG. 1B) or open top or rim such as rim 32*a*. Top 30*a* includes rim 32*a* and closed end 34*a*. There could also be a hinge 36 which couples rim 32*a* to closed end 34*a*.

Figure 1C:
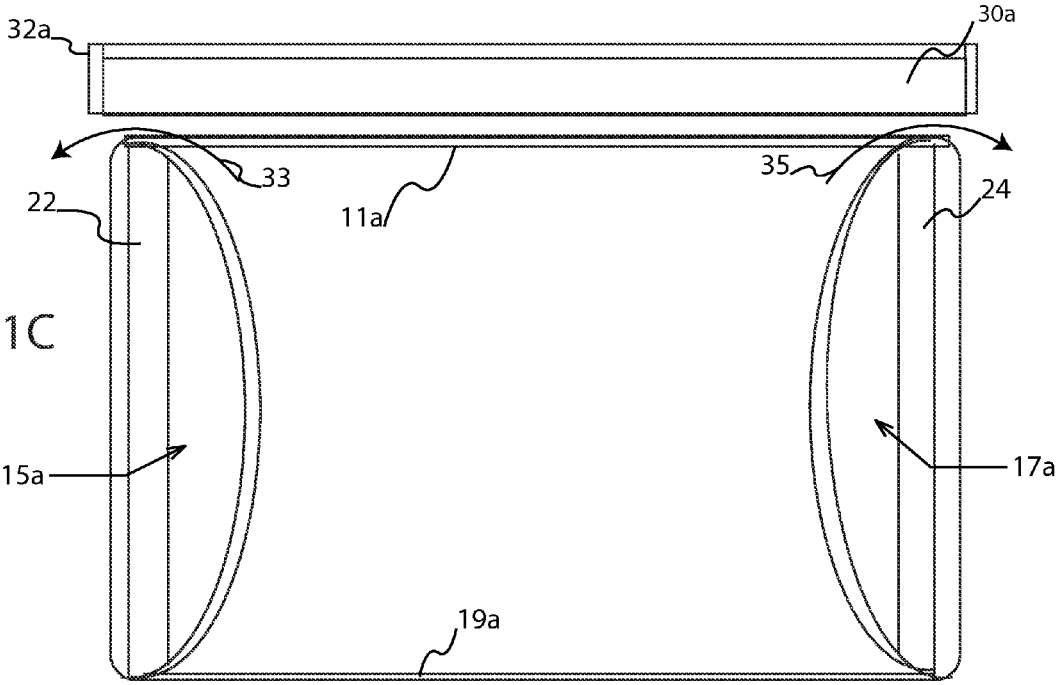
FIG. 1C is a side cut open view of a emesis container with a top.

FIG. 1C is a side cross-sectional view of the emesis container shown in FIG. 1A. In this view, there is shown recesses 15*a* and 17*a* which are configured to receive handles 22 and 24. These recessed regions 15*a* and 17*a* are configured to allow a user to slide his or her hand inside of these regions to grip handles 22 and 24. Handles 22 and 24 can be of any suitable shape but in this case comprise cylindrical elements which extend from a first end to a second end. Handles 22 and 24, recesses 15*a* and 17*a*, and the body of housing 12*a* can be formed as a single piece molded element or in at least one embodiment, handles 22 and 24 can be made from a different material and then attached to housing 12*a* inside of recesses 15*a* and 17*a*. This view also shows rim 32*a* without cover 34*a* fitting over a top rim 11*a* of housing 12*a*.

Thus, when a user wishes to place a bag such as a garbage bag inside of the emesis container, and secure this bag, the user could place the ends over the top of rim 11*a* as shown by arrows 33 and 35, and then place rim 32 over the top of the bag thereby securing the bag in place. These recesses, and in particular inner surfaces 15.1*a* and 17.1*a* are configured to receive emesis into the container and then hold some of the material in the container by virtue of the hourglass shape of the design. Because the inner walls extend in, it can serve to trap the bag as well as the matter inside of the housing to help keep it from flowing out.

Figure 2A:
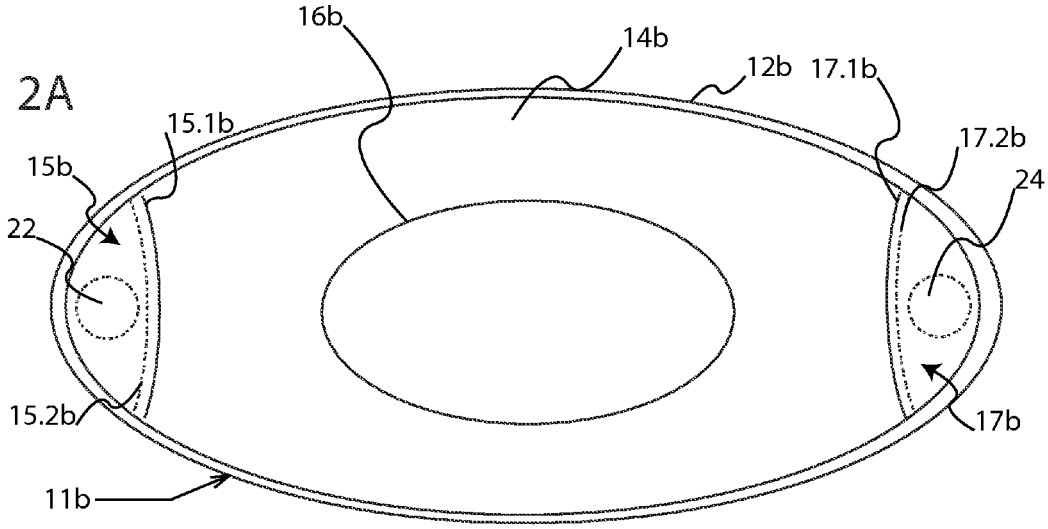
FIG. 2A is a top view of a second embodiment of an emesis container.

FIG. 2A is a top view of a second embodiment of an emesis container. This view shows an oval shaped cross sectional housing 12*b* which includes an oval shaped top opening 14*b* and an oval shaped bottom opening 16*b* as well. There is an upper rim 11*b* as well as recessed regions 15*b* and 17*b* as well. Handles 22 and 24 are positioned inside of recesses or recessed regions as described above. This view also shows inner and outer sides 15.1*b* and 15.2*b* as well as inner and outer sides 17.1*b* and 17.2*b* as well. There is also shown bottom opening 16*b* as well which can be an opening to a different container for housing bags as well. The dashed-dotted lines denoting handles 22 and 24 as well as recesses 15.2*b* and 17.2*b* relate to elements that are not ordinarily visible from this top view.

Figure 2B:
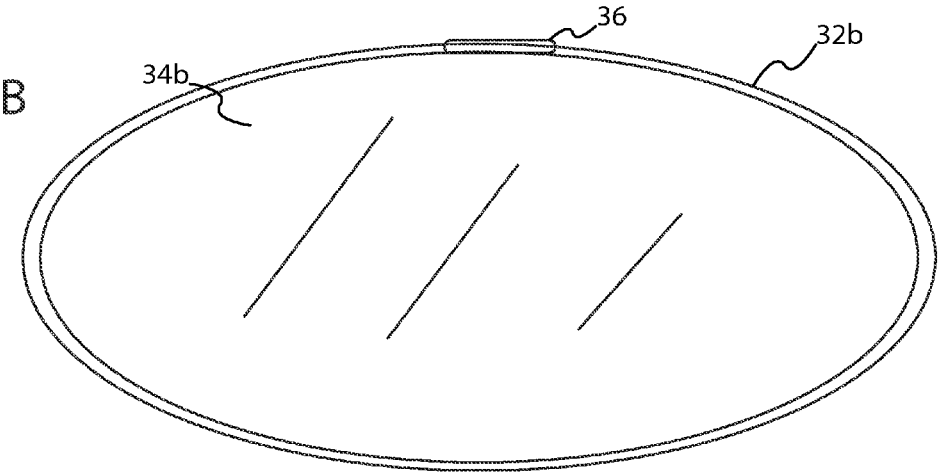
FIG. 2B is a top view of a lid for an emesis container shown in FIG. 2A.
Figure 2C:
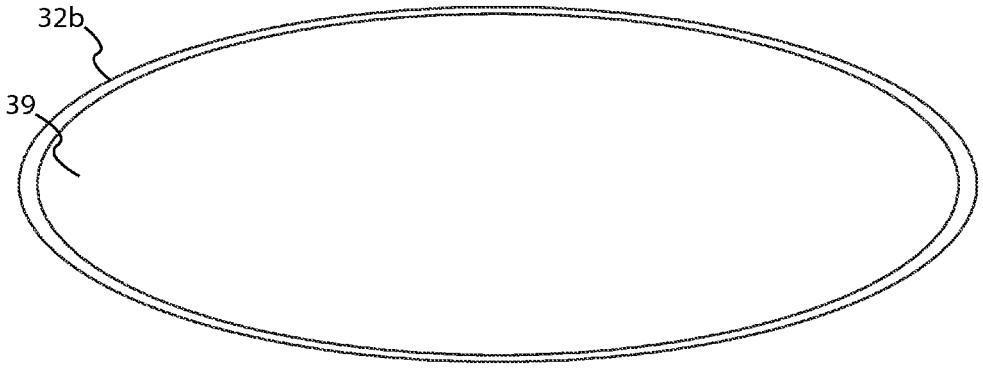
FIG. 2C is a top view of a rim for an emesis container.

FIG. 2B is a top view of a lid for an emesis container shown in FIG. 2A. In this view there is shown a rim 32*b* and a top lid 34*b*, the top lid is coupled to the rim via a hinge 36. FIG. 2C is a top view of a rim 32*b* for an emesis container. This rim does not include a top lid 34*b*. The use of these rims can be beneficial because once these rims are snapped down over the front end of the housing such as over rim 11*a* or rim 11*b*, it can be used to lock the bag in place and to secure the bag against movement or collapse into the housing.

Figure 3A:
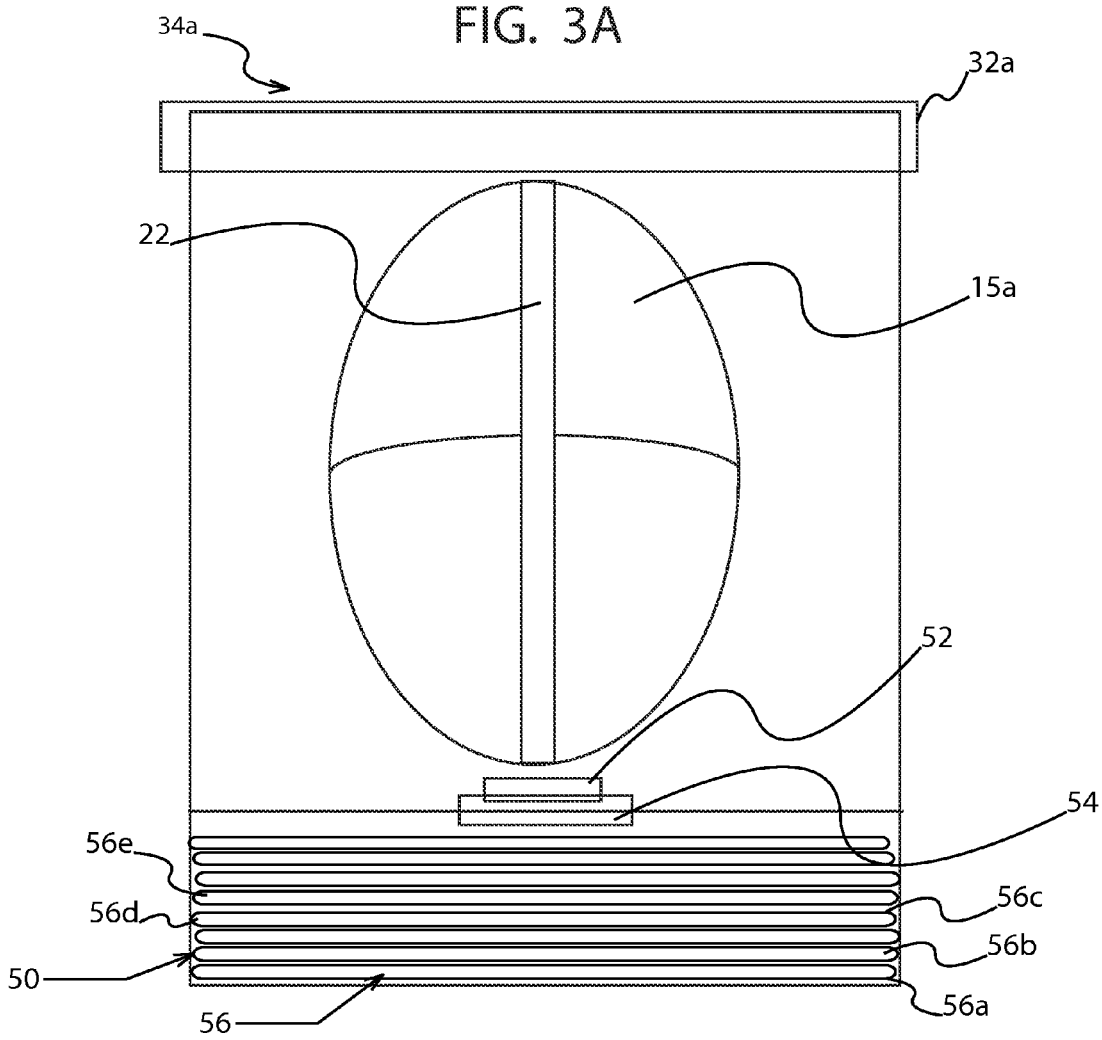
FIG. 3A is a side cut-away view of an emesis container.

FIG. 3A is a side view of an emesis container as shown in FIG. 1A. For example, this side view includes rim 32*a* which can either be an open rim or a rim with a top 34*a* as well. There is also shown a recess region 15*a* which is recessed so as to receive a handle 22 extending from a first end to a second end. There is also a flange 52 which is positioned on housing 12*a* and a clip 54 which is configured to snap over flange 52 to lock second housing 50 into place. Second housing 50 comprises a reservoir or container in which to receive at least one disposable container element such as a garbage bag. For example, the garbage bags can be folded flat and stacked one on top of the other such that the container can include multiple garbage bags 56 such as shown with garbage bags 56*a*, 56*b*, 56*c*, 56*d*, 56*e* etc.

Figure 3B:
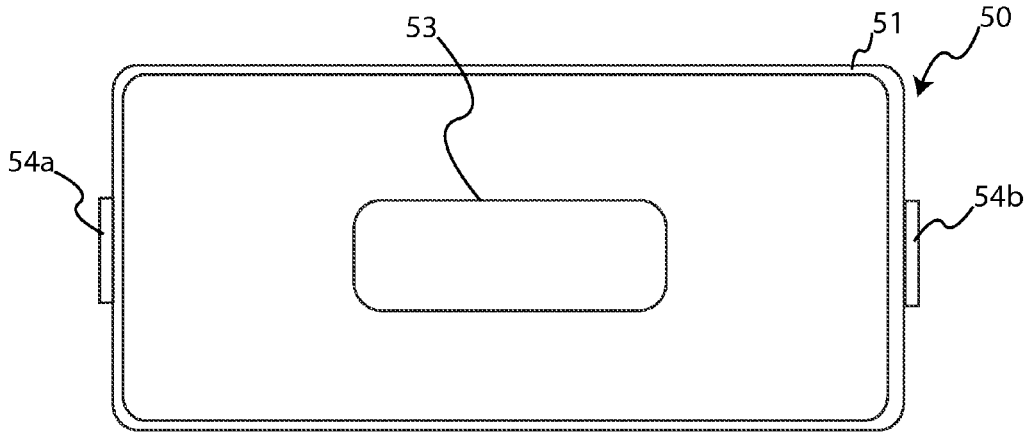
FIG. 3B is a top view of the second container.

Each of these garbage bags can be pulled up through bottom opening 16*a* or 16*b* and then into the remaining portion of housing 12*a*. For example, as shown in FIG. 3B there is a top view of second housing 50 which includes rims 51 and an optional cover 53 which can comprise a flexible material such as a plastic. The optional top can have an opening 53*a* which allows bags 56 to extend therethrough. Second housing 50 includes clips 54*a* and 54*b* on each side of the housing, such as to flange 52 to allow this housing to connect to the bottom of the container.

FIG. 4A is a top cross-sectional view of an emesis container 60, having a body 60*a* having walls 63 and which includes handles 61*a*, and 61*b* as well as openings 62*a* and 62*b* respectively. In addition, there is an open section 64 as well as a bottom door 65 which leads to the second housing. Handles 61*a* and 61*b* are configured in an egg type shape allowing a user to curl his or her fingers around the handle.

FIG. 4B is a side view of the container shown in FIG. 4A. In this view, there is shown a side view with handle 61*a* being shown. Opening 62*a* is also shown and this shows this opening being formed in the side of housing 60. A cover 66 fits over housing 60 and includes a rim 67 having walls 66*c*. Cover 66 also includes a back wall 66*a* which is curved and extends up for a quarter sphere stopping at a front edge. There is also a second section of cover 66 comprising cover section 66*b* which has tab 66*e* and which also includes a tab 66*d* which is configured to allow cover 66 to be locked in an open position as shown in FIG. 4B or a closed position as indicated by the arrow shown in FIG. 4B. This configuration allows a user to open the lid and then insert his or her emesis into the container. The lid can also operate as a backsplash as well.

Figure 5A:
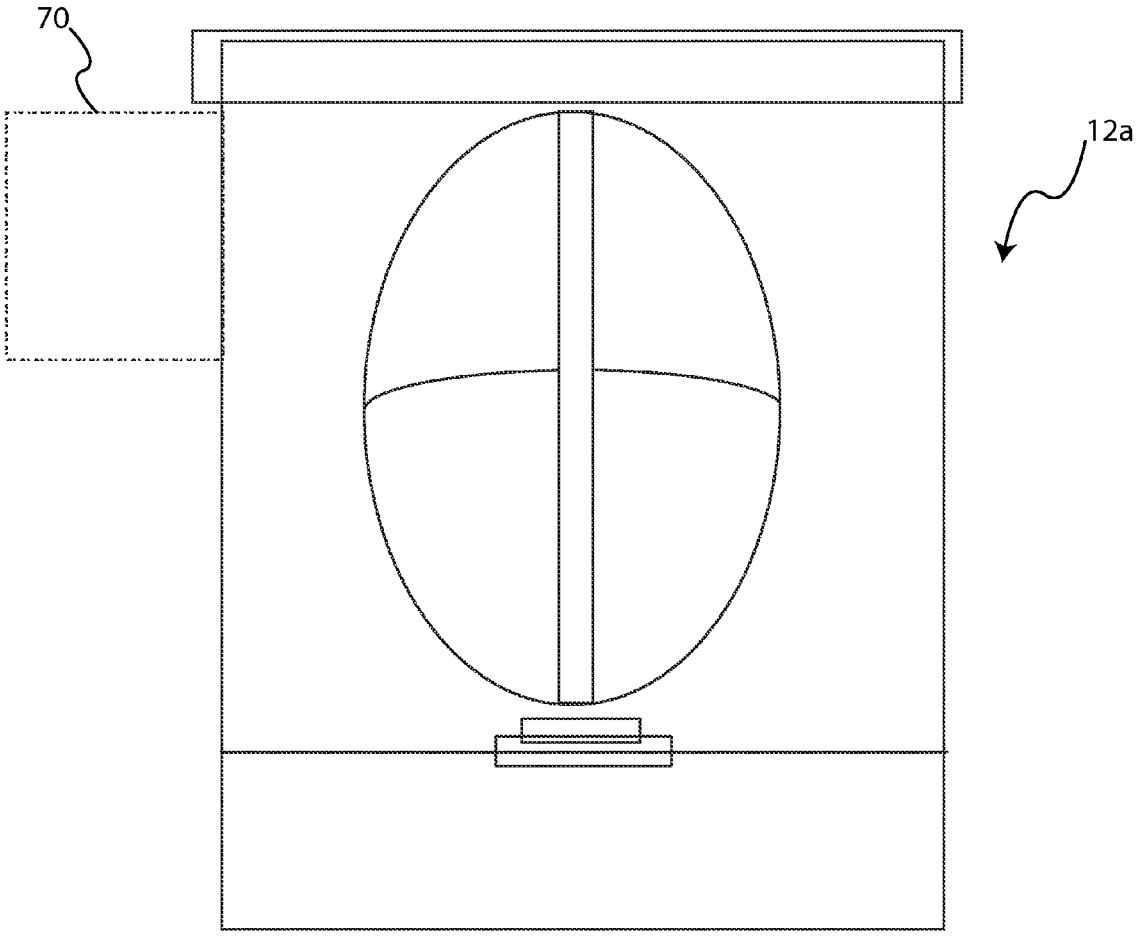
FIG. 5A is a side view of an emesis container having a lid.

FIG. 5A is a side view of a container 12*a* which includes a coupling element 70. This type of coupling element can be in the form of any suitable coupling element such as in the form of a clamp, a male female connection, a fastener or any other suitable connector known in the art.

Figure 5B:
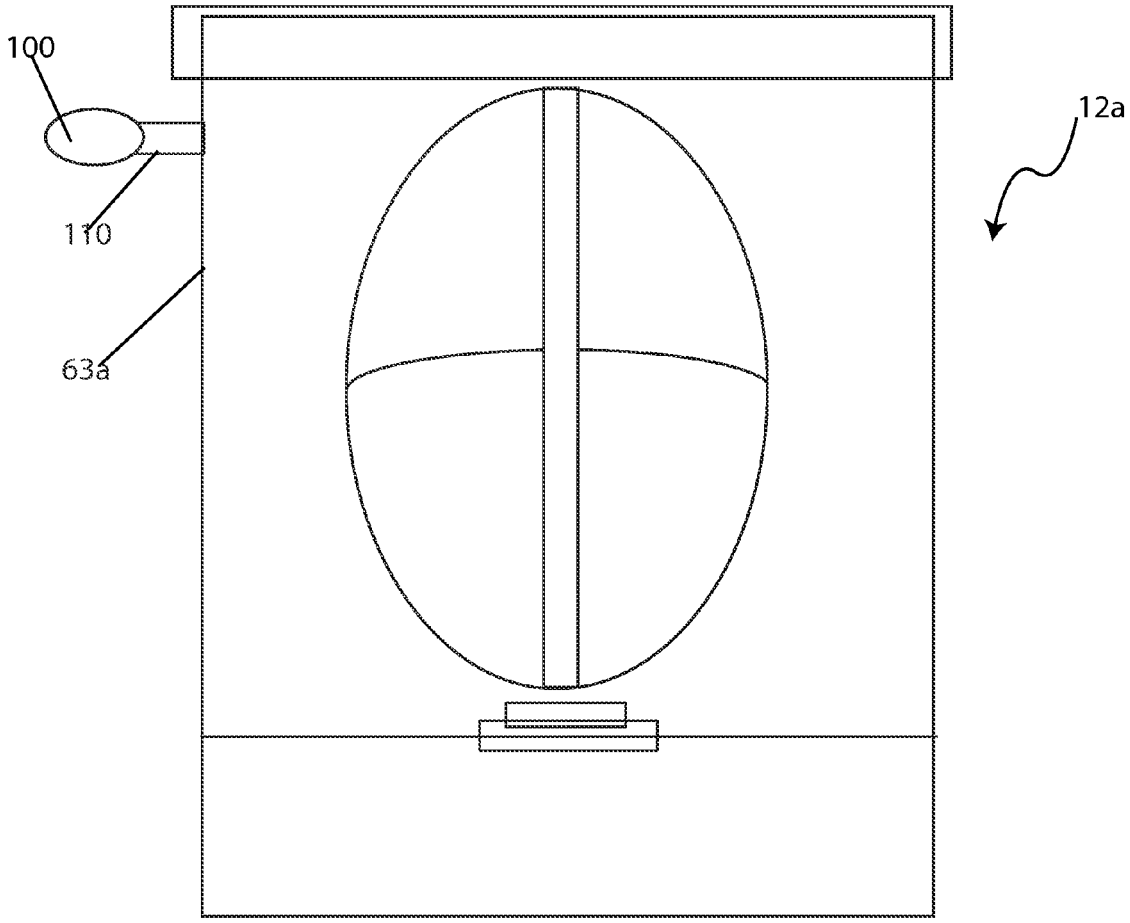
FIG. 5B is a side view of the emesis container having a connector.
Figure 6A:
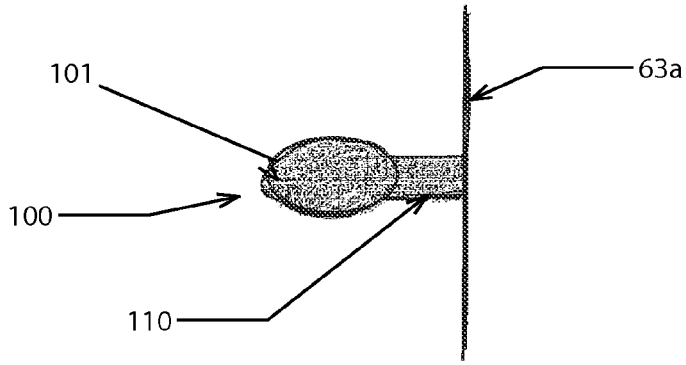
FIG. 6A is a side view of a male connector for the container.

FIG. 5B is a side view of the container including a coupling element 100 shown in greater detail in FIG. 6A. This coupling element is coupled to a back face or back wall 63*a* of the container. This coupling element will be explained in greater detail below.

Figure 5C:
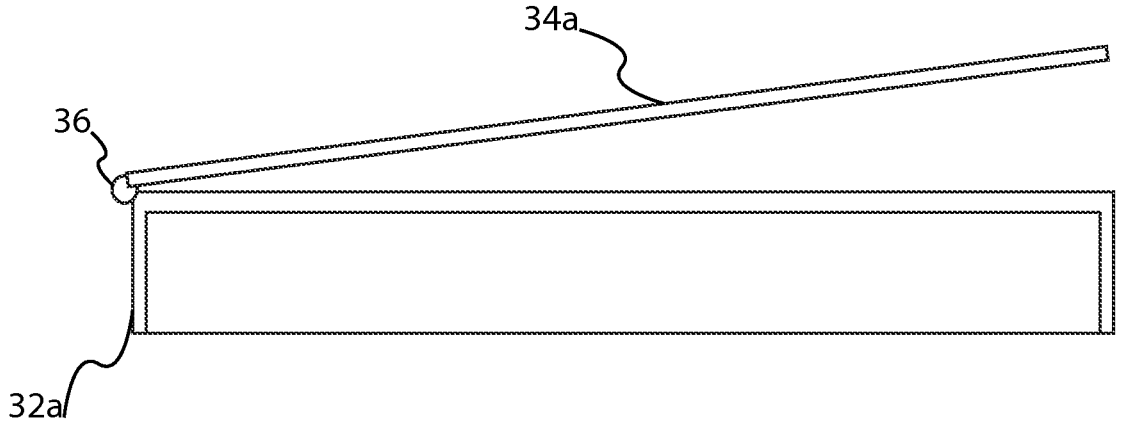
FIG. 5C is a side view of a lid for the emesis container.

FIG. 5C is a side view of a cover which includes a rim 32*a*, a hinge 36 and a top cover 34*a*. This cover could also be used in place of cover 66 shown in FIG. 4B instead.

FIG. 6A is a side view of a male connector for the container. This male connector 100 is coupled to a back wall 63*a* of the housing 60. In addition, extending out from this wall is an extension 110, as well as a catch or bulb 101 which extends into a male bulb shaped element. This bulb shaped element is configured to fit inside of a corresponding female element 130 shown in FIGS. 7, 8 and 9.

Figure 6B:
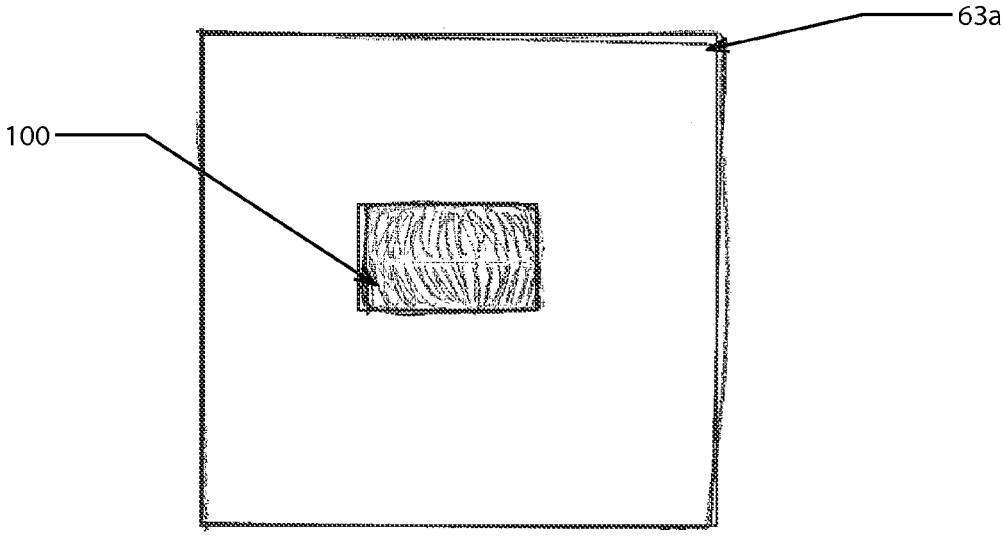
FIG. 6B is an end view of a male connector holding the container.

FIG. 6B is an end view of a male connector 100. Male connector 100 includes an extension 110 to connect the connector, catch or bulb 101 (See FIG. 6C) to the container wall 63*a* of container 60.

Figure 6C:
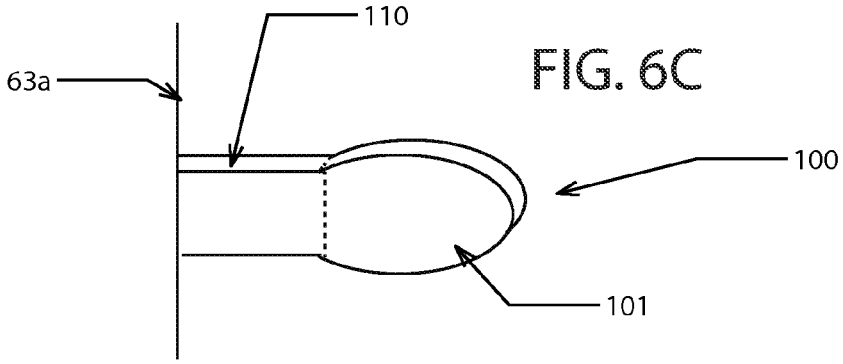
FIG. 6C is a side perspective view of the connector

FIG. 6C is a side perspective view of the male connector shown coupled to back wall 63*a*. Extension 110 is shown extending out from this back wall while bulb or catch is shown having a curved end and substantially flat side walls. These substantially flat side walls are configured to slide in between walls such as walls 135 shown in FIG. 7.

Figure 7:
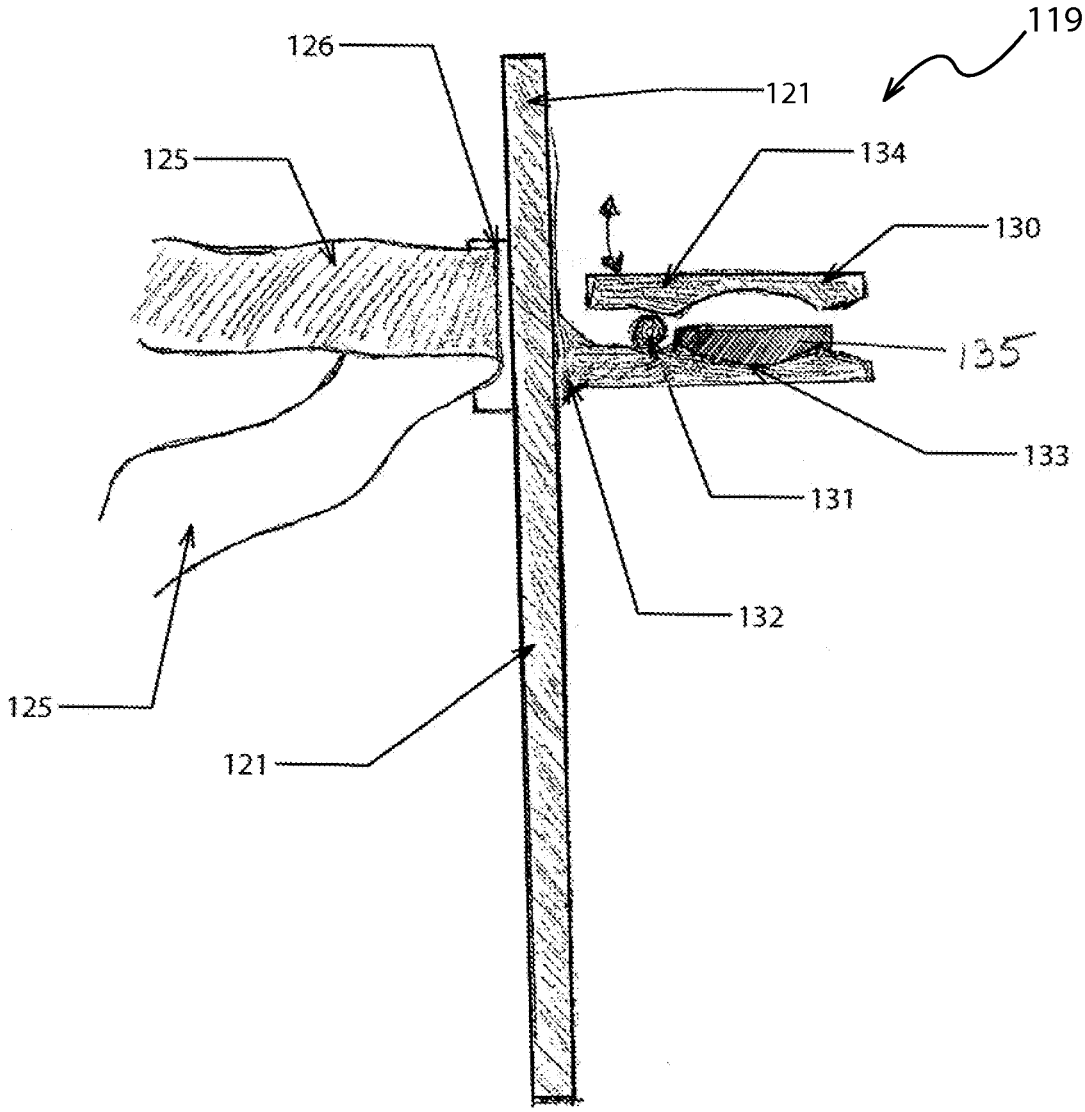
FIG. 7 is a side view of a connector for connecting and holding the container.

FIG. 7 is a side view of the female connector 119 which is connected to a back wall 121. Back wall 121 can be in the form of a flat back plate which is used as a backstop for coupling to a seat in a car such as to a headrest. This connector 119 includes a back strap 125 which is coupled in this case via a bracket 126 to the back end of back wall 121. Strap 125 can be any suitable form of strap which can be in the form of a flexible or stretchable strap 125. There is also a female receiving section 130 which includes two arms 134 and 133 which are spring closable around a spring 131. Spring 131 can be any form of spring such as a coil spring which can be housed in a housing such as a cylinder. Arm 133 is coupled to back plate 121 via a base 132. Base 132 is coupled to plate 121. In addition, arm 134 is coupled to arm 133 via spring 131. With this design, the male bulb fits into the female receiving section to lock the male bulb in place. When the user pulls the container away from the receiving section, it releases these components and allows the user to handle the emesis container freely without the use of the back connector 119. Side walls 135 are configured to receive the bulb 101 into the receiving section and to hold the bulb 101 laterally in place.

Figure 8:
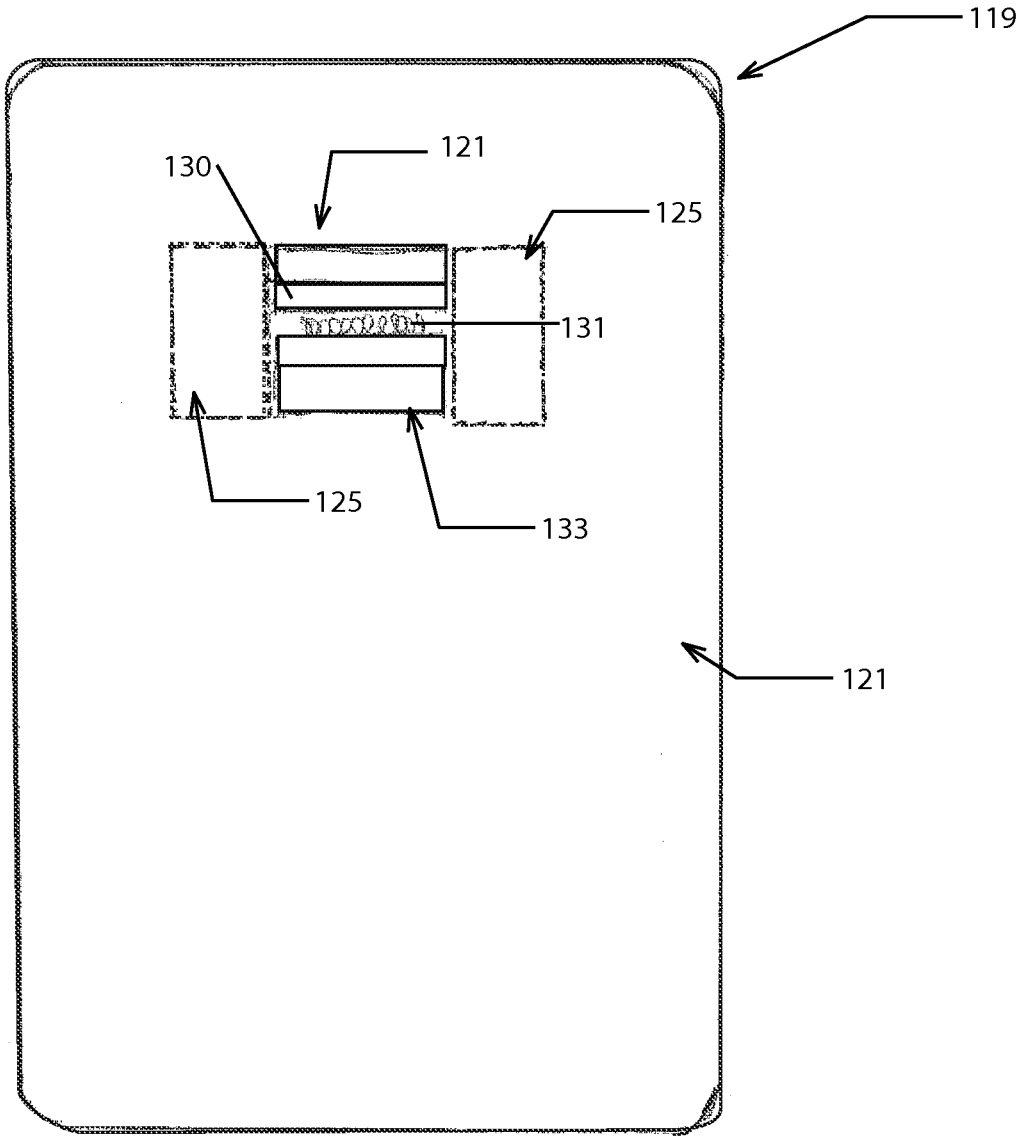
FIG. 8 is an end view of another embodiment of the connector.

FIG. 8 is an end view of the connector 119 which includes a bottom arm 133 and a top arm 134 forming an open connection end 130. This view also shows a dashed line of strap 125 which are not connected to bottom end 133. Disposed between these two ends is a spring 131 as well. This device as shown is coupled to wall 121.

Figure 9:
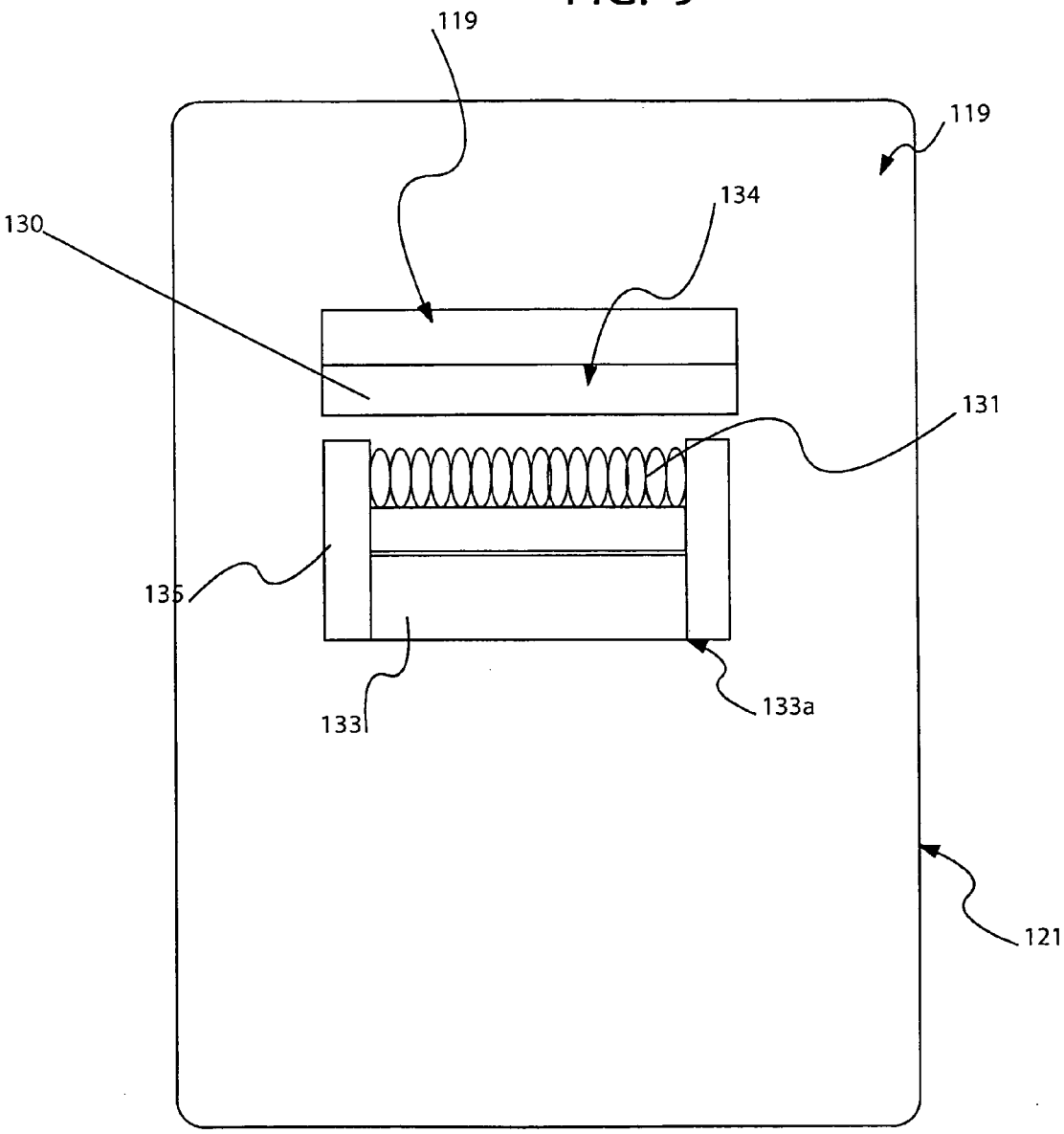
FIG. 9 is an end view of the connector.

FIG. 9 is an end view of another embodiment of the device which includes a U-shaped piece 133*a* which is positioned coupled to the back wall 121. This U-shaped piece 133*a* is configured to house spring 131 which is coupled to top piece 134. Top piece 134 is coupled to spring 131. When top piece 134 is moved, it moves against spring 131 thereby incurring a biasing force. Thus, when male end 101 fits therein, it causes top piece 134 to rotate up and receive this male piece but then clamp down on this male piece as well to hold it in place. When a user wishes to remove male end 101 it causes top piece 134 to rotate up to allow male end 101 to be removed from the housing.

Thus, this connector 119 can be coupled to a back of a headrest or other portion of an automobile and therefore, this connector can then be used to hold the emesis container 10 in place when not in use. The user can then quickly grab the handles of the container pull the container forward releasing the container from the connector 119 and therefore easily use this container.

Accordingly, while at least one embodiment of the present invention have been shown and described, it is to be understood that many changes and modifications may be made thereunto without departing from the spirit and scope of the invention as defined in the appended claims.

What is claimed is:

1. An emesis container comprising:

a housing, said housing having a first compartment, and at least one open end;

a plurality of recessed regions in said housing comprising a first recessed region and a second recessed region, wherein said plurality of recessed regions form surfaces inside of said housing forming a substantially hourglass shape to receive emesis inside of the container and then hold said emesis inside of the container;

a plurality of handles coupled to said housing, with at least a first handle in said first recessed region and a second handle in said second recessed region, wherein said first handle and said second handle extend along a length of the container;

at least one second compartment coupled to said housing;

at least one disposable container element disposed in said at least one second compartment.

2. The emesis container as in claim 1, wherein said housing has at least two openings, a first opening at a first end for allowing access to said at least one second compartment and a second opening at an opposite end.

3. The emesis container as in claim 1, wherein said at least one second compartment has at least one opening for allowing said at least one disposable container element access to said housing.

4. The emesis container as in claim 1, wherein said at least one second compartment further comprises at least one clip for selectively connecting to said housing and disconnecting from said housing.

5. The emesis container as in claim 1, further comprising: at least one rim, which is configured to be selectively coupled over the housing;

at least one top, wherein said at least one top is coupled to said at least one rim; and at least one hinge coupling said at least one top to said at least one rim.

6. The emesis container as in claim 1, wherein said housing has a substantially rectangular opening.

7. The emesis container as in claim 1, wherein said housing has a substantially oval opening.

8. The emesis container as in claim 1, further comprising at least one connector configured to connect the housing to another element.

9. The emesis container as in claim 8, wherein said at least one connector comprises at least two connectors comprising a first connector coupled to said housing, said first connector comprising a male connector, and a second connector comprising a female connector wherein at least one of said at least two connectors is configured to connect to a car seat and at least one of said at least two connectors comprises at least one of a hook and loop fastener, a strap, a clip or a bracket.

10. An emesis container comprising a first housing having at least one first opening at a first end wherein said housing is substantially hourglass shaped and has at least a second opening at a second end, the container further comprises:

at least one detachable rim, wherein said at least one detachable rim is configured to be positioned over a portion of a bag positioned over the first opening of said first housing to hold said bag in place and wherein said housing further comprises at least one recess disposed in said housing, and wherein the container further comprises at least one handle coupled to said housing and disposed in said recess of the housing;

a second housing having an opening aligned with said second opening of said first housing;

a door coupled to said second housing, said door configured to selectively open;

a plurality of bags stored in said second housing;

a housing connector configured to selectively connect said second housing to said first housing a connector configured to selectively connect said first housing to another element for support, wherein said connector is a male connector extending out from a back face of said housing.

11. An emesis container comprising:

a housing said housing having a first compartment, and at least one open end;

a cover, coupled to a first end of said housing, wherein said cover forms a backsplash;

at least one disposable container element disposed in said at least one second compartment;

a plurality of handles extending along a length of said housing;

wherein said housing is hourglass shaped having a plurality of recesses forming inside surfaces and shaped to receive emesis inside of the container and then hold said emesis inside of said container.

12. The emesis container as in claim 11, wherein said cover is dome shaped and wherein the emesis container further comprises:

at least one second compartment coupled to said housing wherein said at least one second compartment further comprises at least one clip for selectively connecting to and disconnecting from said housing;

wherein said housing has at least two openings, a first opening at a first end for allowing access to said at least one second compartment and a second opening at an opposite end;

wherein said at least one second compartment has at least one opening for allowing said at least one disposable container element access to said housing.

13. The emesis container as in claim 11, wherein said cover is configured to be locked in an open position.

14. The emesis container as in claim 11, wherein said plurality of connecting elements comprises a first male connector coupled to said housing and a female connector coupled to a seat of an automobile, wherein said male connector is releasably coupled to said female connector.

15. The emesis container as in claim 14, wherein said female connector comprises at least two arms and a spring.

16. The emesis container as in claim 14, wherein said female connector further comprises a strap configured to couple to a headrest on an automobile.

17. The emesis container as in claim 15, wherein said spring is a coil spring.

18. The emesis container as in claim 10, further comprising a female connector configured to receive said male connector.

19. The emesis container as in claim 18, wherein said female connector further comprises a strap.

* * * * *